United States Patent [19]
Gilmour
[11] 4,295,503
[45] Oct. 20, 1981

[54] AUTOMATIC GLASS FRAGMENTATION DECONTAMINATING SYSTEM FOR GLASS CONTAINERS

[75] Inventor: Alfred J. Gilmour, Waterloo, Canada

[73] Assignee: Auto-Flush Systems Ltd., Waterloo, Canada

[21] Appl. No.: 102,691

[22] Filed: Dec. 12, 1979

[30] Foreign Application Priority Data

Mar. 22, 1979 [CA] Canada ..... 323993

[51] Int. Cl.[3] ..... B65B 3/04; B08B 3/02

[52] U.S. Cl. ..... 141/90; 134/80; 134/183; 141/91

[58] Field of Search ..... 134/78–81, 134/152, 170, 183, 199; 137/238; 141/51, 89, 90, 91, 165, 172, 392; 222/148

[56] References Cited

U.S. PATENT DOCUMENTS 4,207,932 6/1980 Gilmour ..... 141/90

*Primary Examiner*—Frederick R. Schmidt
*Attorney, Agent, or Firm*—James C. Wray

[57] ABSTRACT

Bottle filling machines are known in which bottles travel in a circular path and, while doing so, are filled with liquid under pressure, e.g. beer, by individually associated filler mechanisms. If, because of the pressure, a bottle explodes, glass fragments can adhere to the associated filler mechanism and it is important that these be removed, to keep glass from entering the next bottle coming in. Resort has been made to using water sprays but heretofore such means have been relatively ineffective and in some cases, very messy in operation. The present invention provides apparatus which can thoroughly clean a filler mechanism in the event of an exploding bottle. A broken bottle sensor is located between the infeed mechanism and outfeed mechanism on the bottle filling machine. In the event of a broken bottle, the sensor provides a pulse to activate, for a predetermined period of time, a water spray assembly comprising a plurality of high pressure spray nozzles spaced apart along a portion of the path between the sensor and the outfeed mechanism. The pulse also feeds logic means to record a data bit for each filler tube mechanism associated with a broken bottle, to track the location of the filler tube mechanisms as they move along the path, and to re-activate the spray assembly again for the predetermined period of time when an affected filler tube mechanism again reaches the broken bottle sensor.

16 Claims, 6 Drawing Figures

AUTOMATIC GLASS FRAGMENTATION DECONTAMINATING SYSTEM FOR GLASS CONTAINERS

BACKGROUND OF THE INVENTION

This invention relates to apparatus for cleaning filler tubes, bells, seals and valves on bottle filling machines, hereinafter sometimes referred to simply as filler mechanisms or filler tube mechanisms.

Bottle filling machines have been known for many years. In one very common type of bottle filling machine, the bottles are carried on platforms which are raised by a cam type of mechanism so that each bottle is raised to encircle a filler tube and sealingly engage with a filler bell which may be slidable or fixed on or around the filler tube. When a bottle is in the upper position, its mouth is sealed by a resilient seal at the top of the mount of the bell and liquid enters the bottle through the filler tube. Frequently, this liquid is under pressure, e.g. beer or carbonated drink, and occasionally a bottle will explode due to weak spots, cracks or abuse. An exploding bottle can cause glass fragments to adhere to the under side of the bell, filler and associated parts. It is obviously desirable to remove these glass particles so that they cannot enter a subsequent bottle. There is, therefore, a clear need for some way to ensure removal of glass particles from the filler tube mechanisms.

At present, it is known to use a spray of low-pressure water to clean the filler tube mechanisms but this is a rather slow and inefficient operation. The slowness of the operation results in lost production and hence is costly. Low-pressure water has been used in order not to have it spray into the bottle filling machine and get on or in other bottles in the filler machine. Low-pressure water may, of course, not remove all of the glass particles.

On existing flushing systems the spray angles of the water sprays are at the front infeed side of the filler machine causing water contamination of incoming bottles. Therefore the machine has to be stopped so as to prevent water getting into the bottles when flushing. In the system according to the invention, however, the water spray angle is preferably selected to be across the filler away from the infeed section of the filler machine. Therefore, the machine does not have to be stopped to eliminate water contamination of incoming bottles.

It is also known to spray water continuously at the filling machine for a period of time in hopes of removing glass particles from the affected filler but this is obviously very messy and not particularly efficient. As the water is sprayed from a single location some known arrangements spray the filler mechanisms for only a small fraction of a second each time they pass by, e.g. 0.1 second.

SUMMARY OF THE INVENTION

The present invention provides an apparatus which can thoroughly clean the filler tubes, valves, seals and pedestals (filler mechanisms). Not only is the affected area of the filler mechanism subjected to high-pressure water sprays for quite some time during each rotation of the filler machine, but provision is made so that the affected area passes the spray assembly a plurality of times, for example twice. In this manner, during two rotations of the filling machine, the affected filler mechanism can be subjected to high-pressure water spray for quite some time, e.g. 2.2 seconds. This can be followed by a blast of pressurized air to clean the bells, tubes, seals and pedestals of excess water.

According to the invention, there is provided apparatus for cleaning a filler tube mechanism in a bottle filling machine in which a plurality of bottles travel a path from an infeed mechanism to an outfeed mechanism during filling under pressure by a like plurality of bottle filler tube mechanisms and in which a bottle may explode due to the pressure, causing glass particles to adhere to its associated filling tube mechanisms. The apparatus cleanses the filler tube mechanism a plurality of times and comprises a broken bottle sensor located between the infeed mechanism and the outfeed mechanism. In the event of a broken bottle, the sensor provides a pulse to activate, for a predetermined period of time, a water spray assembly comprising a plurality of high pressure spray nozzles spaced apart along the portion of the path between the sensor and the outfeed mechanism. The pulse also feeds logic means to record a data bit to indicate each filler tube mechanism associated with a broken bottle, to track the location of the filler tube mechanisms as they move along the path, and to re-activate the spray assembly for said predetermined period of time when the filler mechanism again reaches the sensor.

The invention is versatile and flexible in that it can be run fully automatically, semi-automatically and manually. The flushing activation can be made under all possible conditions. No direct participation by the operator is required, thereby eliminating human error and poor response time and improving human safety.

Improved quality, safety, and higher productivity is a direct benefit of the present invention. By this invention, starting and stopping of the bottling line is eliminated, thereby improving equipment life and reducing power surges.

The filling machines can have either left or right hand bottle feed travel.

DESCRIPTION OF THE PREFERRED EMBODIMENTS

Figure 1:
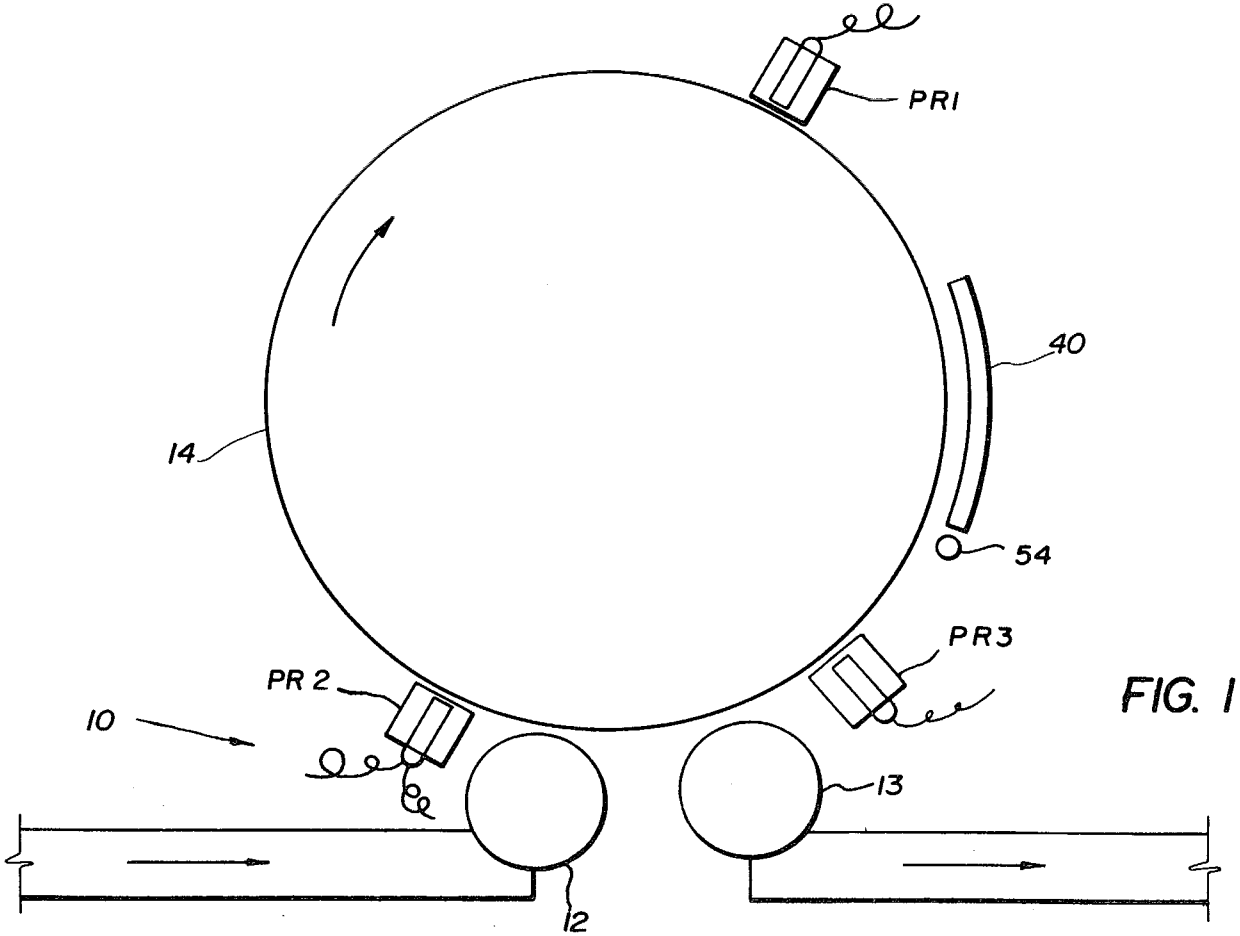
FIG. 1 is a highly schematic diagram of a bottle filling machine showing portions of the present invention.

Referring to FIG. 1, there is shown a bottle filling machine 10 having an infeed timing mechanism 12 and an outfeed timing mechanism 13. Bottles, not shown, are fed into the rotating part 14 of the filling machine by the infeed timing mechanism 12 and travel in the direction of the arrow until they are removed by the outfeed mechanism 13. During their travel in the filling machine, the bottles are filled with fluid by filler tube mechanisms, such as, for example, the type shown in FIGS. 3*a* and 3*b*, although other types of filler mechanisms could be used.

Figure 3A:
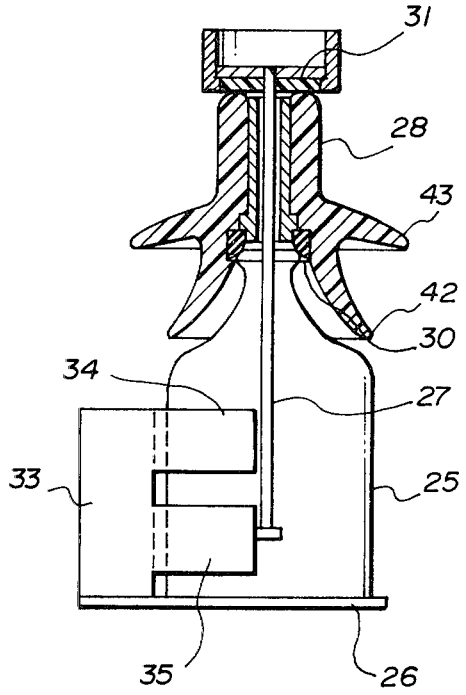
FIGS. 3*a* and 3*b* illustrate one type of filler tube, bell and seal which may be used with the present invention.

Referring briefly to FIG. 3*a*, the bottles 25 are carried by platforms 26 and a cam mechanism (not shown)

raises them up until they surround the filler tube 27 and sealingly engage with the filler bell 28. Specifically, the mouth of the bottle engages with a resilient seal 30 of, for example, rubber or other suitable material. Also, the top of the bell 28 engages with a resilient seal 31. Liquid for filling the bottle 25 enters the bottle through the filler tube 27.

Figure 3:
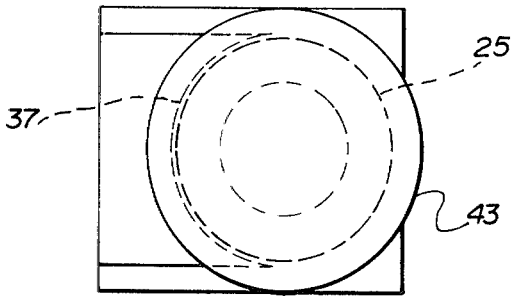

The platform 26 is provied with a bottle guide 33 which may, for example, comprise two arms 34 and 35 of resilient material such as rubber. As best seen in FIG. 3(*b*) the arms 34 and 35 have an arcuate bottle guiding surface 37 which is of substantially the same radius as the bottle 25.

During normal operation, a platform will be lower (typically by one half inch) if it has a bottle on it than if it does not. This difference in platform height is readily detected by sensor PR1 (FIGS. 1 and 4) which may be magnetic or optical, for example, and produces an output signal which is used as explained in connection with FIG. 4. Sensor PR1 can also be placed in other areas to reference a broken bottle, besides using the difference in pedestal heights.

Figure 2:
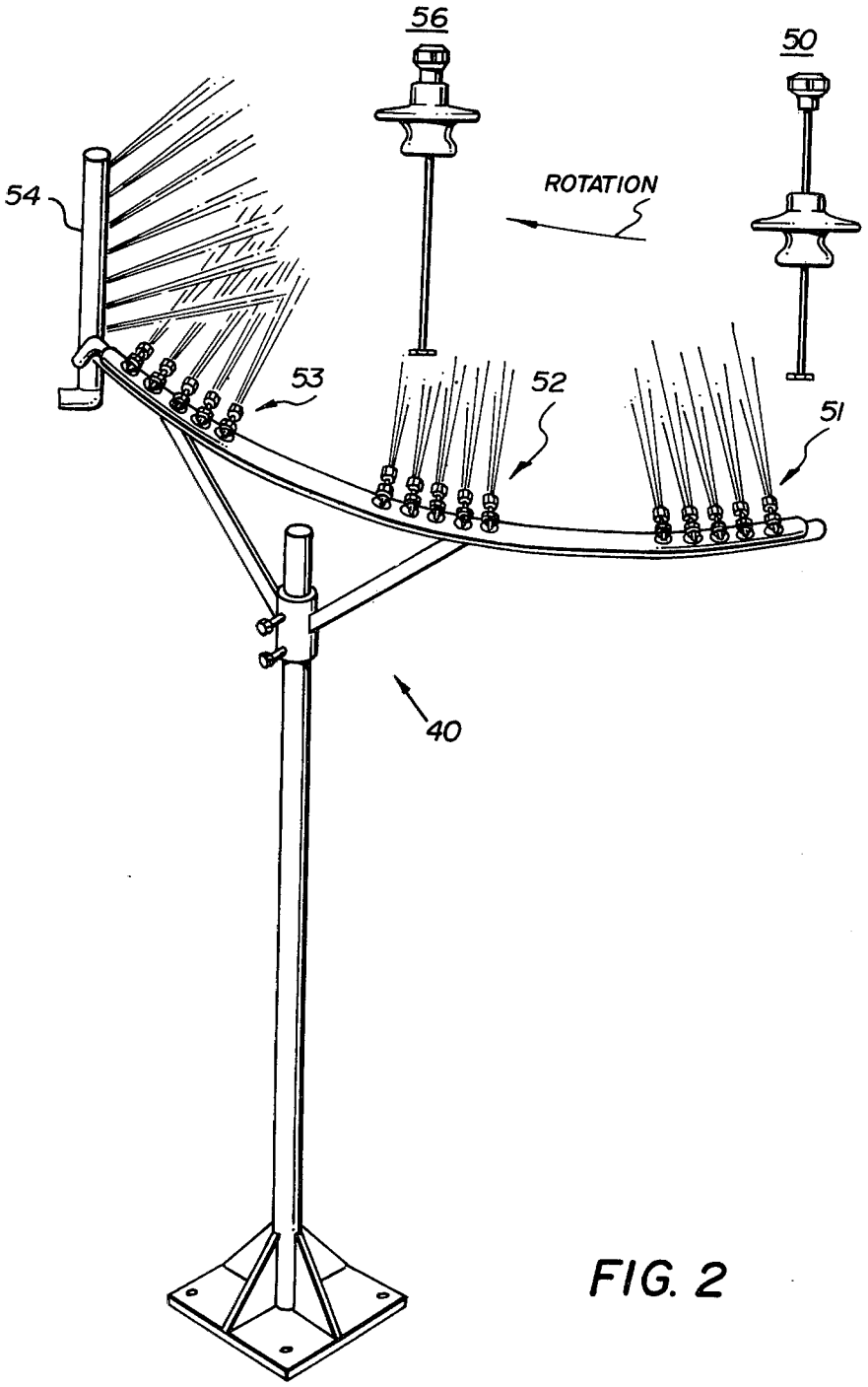
FIG. 2 is a diagram of a spray assembly and air blast which may be used in the present invention.

FIG. 2 shows one type of spray stand 40 which may be used with the present invention and illustrates two positions of a bell and filler tube of a type which may be used in this invention. At position 50, the bell and filler tube have not yet entered the path of water sprayed from nozzles 51 and the bell is relatively low on the tube, being retained as shown in FIGS. 3(*a*) and 3(*b*) by guide 33. Position 56 shows a bell in accordance with the invention at the top of the tube, it being assumed that a water spray has lifted it there.

FIG. 2 shows the nozzles being divided into three groups 51,52 and 53. In between groups 51 and 52 and between 52 and 53, the bell drops down and hits the guide 33, shown in FIG. 3(*a*), and this causes jarring of the bell which further aids in dislodging glass particles.

FIG. 2 also shows an air blast arrangement 54 which follows the spray stand. This helps to dry the bells, seals, valves, pedestal and filler tubes.

It is to be understood that the spray stand and air blast arrangement shown in FIG. 2 is merely illustrative. The present invention is not limited to arrangements of this particular configuration. The main thing is to have a plurality of spray nozzles to ensure washing of the filler mechanisms for an extended period of time as they pass by. Also, the invention is not limited to the particular type of bell and filler tube shown. For example, the invention can be used with filler mechanisms in which the bell does not slide up and down the filler tube. Furthermore, nozzles can be provided to ensure washing the pedestals.

Figure 4:
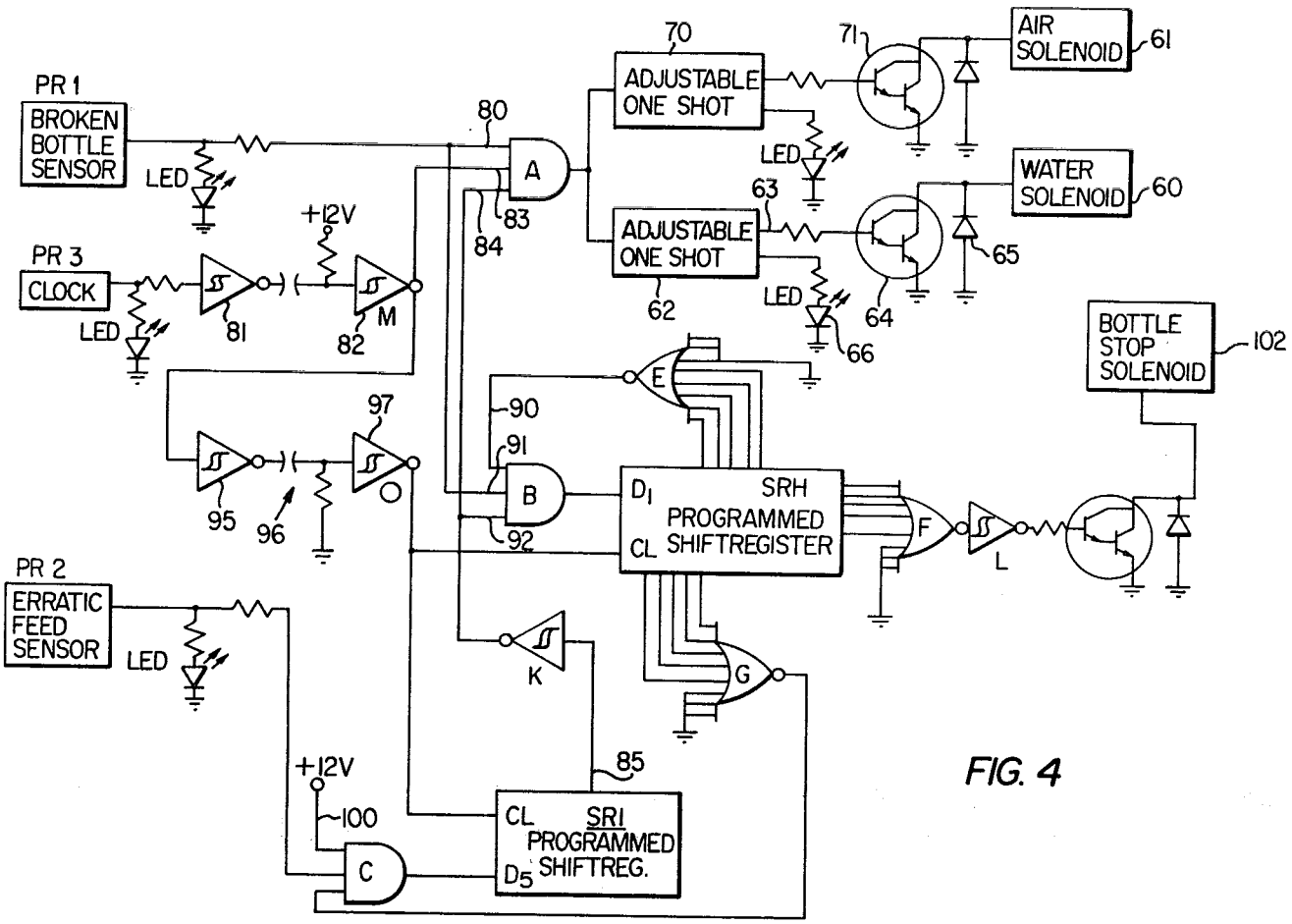
FIG. 4 is a partly block, partly schematic diagram of circuitry in accordance with a preferred embodiment of the invention.

Referring to FIG. 4, there is shown a partly block, partly schematic diagram of a preferred arrangement according to the invention which enables a filler mechanism to be subjected to the water spray and air blast twice before a new bottle is allowed to enter the filling machine at the location of a filler tube mechanism at which a broken bottle has been detected.

Referring to FIG. 1, the filling machine 14 will rotate twice past the water spray assembly 40 and air blast 54 before a new bottle is fed in by infeed mechanism 12. This ensures thorough cleaning of the filler mechanism before a new bottle enters the machine.

In FIG. 1, PR1 is a broken bottle sensor which, as explained above, detects a broken bottle by sensing changes in height of the platform 26 shown in FIG. 3(*a*), or any other reference point. In the event of a broken bottle, the sensor PR1 provides a pulse to activate, for a predetermined period of time, the water spray assembly 40 (FIGS. 1 and 2). The water spray assembly comprises a plurality of high-pressure spray nozzles spaced apart along a portion of the path travelled by bottles in the filling machine between the sensor PR1 and outfeed mechanism 13, this being evident from FIG. 1. The pulse from the broken bottle sensor also feeds logic means to record a data bit to indicate each filler tube mechanism associated with a broken bottle, to track the location of each such filler tube mechanism as it moves along the path in the filling machine, and to re-activate the spray assembly 40 for the aforementioned period of time when any such filler mechanism again reaches the sensor PR1. In this embodiment, the spray assembly is activated twice, as explained above.

FIG. 4 also shows sensors PR2 and PR3. As indicated in FIG. 1, sensor PR2 is fitted at infeed mechanism 12. Sensor PR3 can be mounted anywhere but preferably above position 54. To avoid confusing the drawing it has been shown downstream of air blast arrangement 54 in FIG. 1 of the drawings. Sensor PR2 is an erratic feed sensor which detects failure of the infeed mechanism 12 to feed a bottle into the filling machine. It can operate in the same manner as sensor PR1, i.e. by detecting platform height or any other determined reference point. The reason for providing this sensor will become evident later on in this description.

In order to coordinate operation of the circuitry shown in FIG. 4, a souce of clock pulses is also necessary, these being synchronized with the speed of the filling machine. The clock sensor PR3 may sense the passage of filler tubes or stands or other parts of which there is one for each filler mechanism position. Utilizing a clock signal derived in this manner provides the advantage that the circuitry can operate over a wide range of filling machine speeds from 100 bottles per minute to, for example, 2000 bottles per minute.

The erratic feed sensor PR2 provides a signal which is utilized by the logic circuitry to prevent activation of the spray assembly and water blast which would be unnecessary.

Note that sensor PR1 is located quite some distance from the infeed mechanism 12. It has been discovered that exploding of bottles usually takes place relatively soon after entering the filling machine. By having sensor PR1 spaced well down stream of the infeed mechanism, it is less likely to be exposed to flying glass and liquid from an exploding bottle. Of course, the sensor is also preferably additionally protected by a suitable casing or the like.

The control circuitry of FIG. 4 does not contain moving parts (not counting the solenoids) and this ensures a very long and reliable life expectancy of the circuit components and greatly reduces the likelihood of breakdowns.

The logic circuits used are preferably CMOS (Complimentary-Metal-Oxide Semiconductor). Circuits of this type have a number of advantages over, for example, TTL logic, such as:

1. a high immunity to external noise which is an obvious advantage in industrial usage,
2. at low speeds, for example involving pulse repetition rates below one million per second, power consumption is very low (microwatts);
3. power supply requirements are much less than for TTL logic circuits;

4. supply voltages can vary anywhere between 3 and 15 volts which makes it easy to interface with other circuits operating within that voltage range.

The low voltage sensors and solenoids used in the present invention provide a safety factor as compared to higher voltage devices which is important in view of the fact that water is being sprayed around.

Referring again to FIG. 4, the control apparatus uses two shift registers SRH and SRI. Shift register SRH contains as many stages as are needed for a particular bottle filling machine (one for each filler tube mechanism). Programmable shift registers, in cascade, may be used. Shift register SRI contains as many stages as are needed to represent the stages on the filling machine between sensors PR2 and PR1. The water spray assembly is activated by energizing a water solenoid 60 and the air blast 54 is activated by an air solenoid 61. Water solenoid 60 is energized by the output 63 of one-shot 62 being amplified by a Darlington pair 64 and applied to water solenoid 60. Diode 65 across the output of Darlington pair 64 is a protection diode provided to shunt any induced back current to ground. An LED (light emitting diode) 66 can be provided to provide a visible indication of an output from one-shot 62.

In a similar manner air solenoid 61 is controlled by the output of an adjustable one-shot 70 applied through a Darlington pair 71. The adjustable one-shots 62 and 70 are retriggerable monostable multivibrators which may be adjusted to provide outputs of 0.5 to 6 seconds, for example, so that the water solenoid 60 and air solenoid 61 can be energized for different lengths of time depending on the speed of operation of the bottle filling machine.

Figure 5:
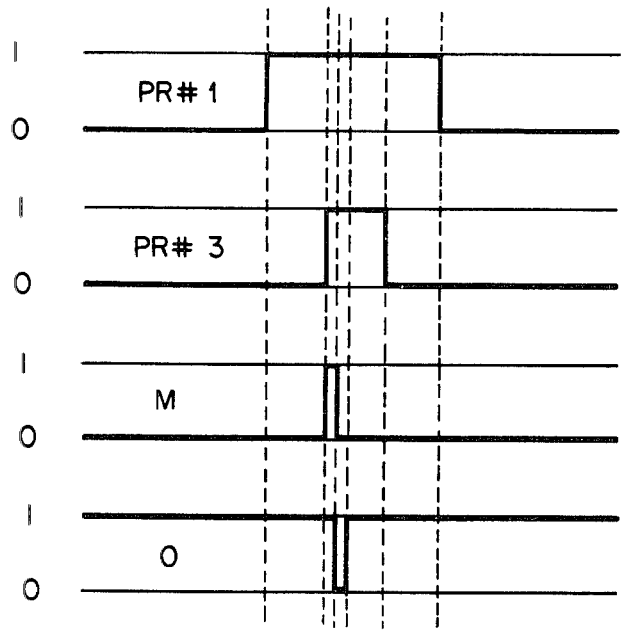
FIG. 5 shows waveforms useful in explaining the operation of the circuitry shown in FIG. 4.

As seen in FIG. 5, the broken bottle sensor PR1 provides a relatively long duration pulse which is present before and after the occurrence of a clock pulse from clock sensor PR3. The output of PR1 is applied to input 80 of AND gate A while the clock pulse from PR3 is applied, via inverters 81 and 82, to a second input, input 83 of AND gate A. The third input 84 of AND gate A is derived from the output 85 of shift register SRI via inverter K. The input 84 is normally high so that the occurrence of pulses on inputs 80 and 83 enable the gate A which triggers the one-shots 62 and 70 to produce outputs which are amplified by Darlington pairs 64 and 71 to activate water solenoid 60 and air solenoid 61.

The data input of shift register SRH is derived from the output of AND gate B. AND Gate B has one input 90 which is derived from the output of NOR Gate E whose inputs are derived from selected stages of shift register SRH. Normally input 90 is high. The second input, input 91, of AND Gate B is derived from broken bottle sensor PR1 and the third input 92 is derived from the output of inverter K in the same manner as input 84 of Gate A. As mentioned above, the output of PR1 extends before and after the subsequent clock pulse PR3. This clock pulse is taken from the output M of inverter 82, inverted again in inverter 95, delayed by capacitor-resistor combination 96, inverted again by inverter 97 and then applied as output O (See also FIG. 5) to the clock input CL of shift register SRH. The occurrence of this clock pulse causes a data bit to be entered into the shift register SRH. Subsequent clock pulses shift this data bit through the shift register.

All entering and shifting of data occurs only during the positive going edge of the clock signal. The shift registers are controlled by clock pulse O (the output of inverter 97), thus entering and shifting data on the trailing edge only. This prevents any data shifting from taking place during triggering of the one-shots 60 and 61, which will trigger first on the leading edge of clock pulse M from the output of inverter 82. In this arrangement, positive logic is used. Logic 1 is at or near +12 volts; logic 0 is at or near 0 volt.

At the start of a sequence, both shift registers SRH and SRI contain no data, and the output of gates E, F, G and K are at logic 1 (high).

Gate E enables one input on AND Gate B.

Gate K enables one input on each of AND Gates A and B as explained above.

Gate G enables one input on AND Gate C, the output of which is applied to the data input D5 of shift register SRI.

Plus 12 volts is always applied to input 100 of AND Gate C so that it is always enabled.

Gate K also enables one input on Gate A.

Clock signal M enables one input on Gate A every clock pulse.

When sensor PR1 detects a raised platform (which indicates a broken bottle) it enables one input each on Gates A and B. Gate B puts a logic high on the data input of shift register SRH. Clock pulse M enables the input 83 on Gate A and, thus, triggers one-shots 62 and 70 to energize the solenoids 60 and 61 for water and air.

On the trailing edge of clock pulse 0 data is entered into the first stage of shift register SRH. With every subsequent clock pulse O, the data in shift register SRH shifts and after a predetermined number of stages, the input to Gate F goes high for 5 consecutive clock pulses. The bottle stop solenoid 102 is thus activated and creates a gap of approximately a minimum 5 bottles in the infeed to the bottle filling machine. At higher speeds, due to time delays, a 6 to 8 bottle gap will occur. When this gap on the filling machine reaches the erratic infeed sensor PR2, the third input to Gate C will be high and would put a high on the data input of SR1. This is not wanted because the five (or more) bottle gap is not an erratic bottle feed and should not be entered as such.

Going back a moment to consider SRH, at the same time the five bottle gap reaches PR2, the output of gate G (which was high) becomes low for five clock pulses, thus disabling Gate C and preventing data from entering shift register SRI.

At the time that the bottle gap reaches broken bottle sensor PRI, the flushing system will trigger for the duration of the bottle gap, plus the preset time of both one shots 62 and 70. Since this was the second flush, it is not desired to have this bottle gap be entered again in shift register SRH through gate B. Thus, one stage before this gap would reach the sensor PR1, the input to Gate E goes high for five clock pulses. Thus, its output goes low to disable Gate B and prevent data from entering shift register SRH.

After this, the data present in shift register SRH will reach the last stage and shift out of the shift register, the last output stage being floating.

In case of erratic infeed of bottles into the filler, these gaps will enter in SRI as data (via Gate C) and before the gaps reach broken bottle sensor PRI, the output of SRI will, through Gate K, disable both Gates A and B, so that no trigger signals can reach the one shots and no data will appear on the input of SRH. As a result, the flushing system will not be activated by erratic infeed of bottles.

LED's, not referenced, may be provided to indicate operation of the sensors.

The system is provided with a test button to simulate a blown bottle to ensure proper system functioning. An operator can test the system by removing one bottle from the infeed flow and pressing button. Button is held depressed until the empty pedestal passes infeed sensor PR2. This disables infeed sensor PR2 momentarily and simulates a broken bottle which in turn is detected by PR1. The system will now go through a complete flushing cycle.

What I claim as my invention is:

1. In a bottle filling machine in which bottles travel a path from an infeed mechanism to an outfeed mechanism during filling under pressure by a plurality of bottle filling tube mechanisms and in which a bottle may explode due to said pressure, causing glass particles to adhere to its associated filler mechanism, apparatus for cleansing said filler tube mechanisms a plurality of times comprising a broken bottle sensor located between said infeed mechanism and said outfeed mechanism which, in the event of a broken bottle, provides a pulse to activate, for a predetermined period of time, a water spray assembly comprising a plurality of high pressure spray nozzles spaced apart along a portion of said path between said sensor and said outfeed mechanism, said pulse also feeding logic means to record a data bit to indicate each filling tube mechanism associated with a broken bottle, to track the location of said filling tube mechanisms as they move along said path, and to reactivate said spray for said predetermined period of time when each said filling tube mechanism again reaches said sensor.

2. Apparatus as claimed in claim 1 wherein said plurality of times is at least two.

3. Apparatus as claimed in claim 2 wherein said logic means comprises a first shift register having a data input to which said pulse is applied and a clock input fed by clock pulses synchronized with said movement of said bottle filling machine so that one clock pulse is produed each time a filler tube mechanism moves a predetermined distance.

4. Apparatus as claimed in claim 3 in which a data bit is shifted in said shift register by said clock pulses and produces a first series of output pulses to activate a bottle stop mechanism to prevent bottles entering the machine at the location of the filler tube mechanism associated with a broken bottle and at at least two locations before and after said location to produce a multibottle gap.

5. Apparatus as claimed in claim 4 including a missing bottle detector for detecting erratic feed of bottles into said machine, said missing bottle detector producing a pulse if a bottle is missing which is detected by said logic means to prevent said spray assembly being activated by said broken bottle detector which subsequently produces a pulse when the filler tube mechanism associated with the missing bottle passes it.

6. Apparatus as claimed in claim 5 wherein a pulse from said missing bottle detector is stored in a second shift register and shifted by said clock pulses so as to produce an output pulse at a time corresponding to the time the associated filler tube mechanism reaches the broken bottle detector, the output pulse of said second shift register causing said logic means to prevent a pulse from the broken bottle detector being stored in said first register or from activating said spray assembly.

7. Apparatus as claimed in claim 6 wherein said first shift register produces a series of output pulses at a time when the multibottle gap reaches the broken bottle detector, said series of output pulses being utilized by said logic means to prevent pulses from the broken bottle detector, causec by the multi-bottle gap, from energizing the spray assembly or entering data into said first shift register.

8. Apparatus as claimed in claim 7 wherein said logic means includes a first AND gate having a first input to which is applied pulses from the broken bottle detector, a second input to which is applied said clock pulses, and a third input to which is applied the normally-high output of said second shift register and an output which is applied to means for activating the water spray assembly.

9. Apparatus as claimed in claim 8 wherein the output of said first AND gate is also applied to means for activating an air blast assembly.

10. Apparatus as claimed in claim 9 wherein said air blast assembly is located on said path at a location following said spray assembly.

11. Apparatus as claimed in claim 10 wherein said shift registers have clock inputs for shifting data and clock pulses applied thereto are delayed with respect to the clock pulses applied to said first AND gate.

12. Apparatus as claimed in claim 8 wherein said logic means includes a second AND gate having a first input to which is applied pulses from the broken bottle detector, a second input to which is applied the normally-high output of said second shift register, a third input to which are applied disabling pulses from said first shift register only when a multi-bottle gap passes the broken bottle detector, and an output which feeds a data input of said first shift register.

13. Apparatus as claimed in claim 1, 2 or 3 wherein said broken bottle detector is located a distance along said path from said infeed mechanism a distance greater than the length of path in which exploding bottles are normally encountered whereby it is not exposed to flying glass from exploding bottles.

14. Apparatus as claimed in claim 10, 11 or 12 wherein said broken bottle detector is located a distance along said path from said infeed mechanism a distance greater than the length of path in which exploding bottles are normally encountered whereby it is not exposed to flying glass from exploding bottles.

15. Apparatus as claimed in claim 10, 11 or 12 wherein said missing bottle detector is located near said infeed mechanism.

16. Apparatus as claimed in claim 1 in which said pulse also feeds said logic means to activate a bottle stop mechanism to prevent bottles entering the machine at the location of the filler tube mechanism associated with a broken bottle and at at least two locations before and after said location to produce a multi-bottle gap.

* * * * *

UNITED STATES PATENT OFFICE
CERTIFICATE OF CORRECTION

Patent No. 4,295,503 Dated October 20, 1981

Inventor(s) Alfred J. Gilmour

It is certified that error appears in the above-identified patent and that said Letters Patent are hereby corrected as shown below:

Claim 5, line 6 (Column 7, line 56) "broken bottle detector" should be "broken bottle sensor".

Claim 7, lines 5 and 6 (Column 8, lines 10 and 11) "borken bottle detector" should be "broken bottle sensor".

Claim 8, line 3 (Column 8, line 16) "broken bottle detector" should be "broken bottle sensor".

Claim 12, lines 3 and 4 (Column 8, lines 34 and 35) "broken bottle detector" should be "broken bottle sensor".

Claim 13, line 2 (Column 8, line 42) "broken bottle detector" should be "broken bottle sensor".

Claim 14, line 2 (Column 8, line 48) "broken bottle detector" should be "broken bottle sensor".

Signed and Sealed this

*Second* Day of *March 1982*

[SEAL]

*Attest:*

GERALD J. MOSSINGHOFF

*Attesting Officer* *Commissioner of Patents and Trademarks*